United States Patent [19]

Adams et al.

[11] Patent Number: 4,753,624

[45] Date of Patent: Jun. 28, 1988

[54] RESILIENT DISC COIN SORTER HAVING RECESSES CONVERGING IN THE DIRECTION OF COIN TRAVEL

[75] Inventors: Thomas P. Adams, Oconomowoc; John H. Winkelman, Hartland, both of Wis.

[73] Assignee: Brandt, Inc., Watertown, Wis.

[21] Appl. No.: 32,101

[22] Filed: Mar. 27, 1987

[51] Int. Cl.[4] ..... G07D 3/00

[52] U.S. Cl. ..... 453/10

[58] Field of Search ..... 453/3, 9, 10, 12, 13; 221/167, 168, 169; 209/539, 915, 917, 918, 919, 922; 198/392

[56] References Cited

U.S. PATENT DOCUMENTS

| | | | |
|---|---|---|---|
| 3,300,022 | 1/1967 | Sterling | 198/392 X |
| 4,086,928 | 5/1978 | Ristvedt et al. | 133/3 A |
| 4,098,280 | 7/1978 | Ristvedt et al. | 133/3 A |
| 4,234,003 | 11/1980 | Ristvedt et al. | 133/3 A |
| 4,444,212 | 4/1984 | Ristvedt et al. | 133/3 A |
| 4,531,531 | 7/1985 | Johnson et al. | 133/3 A |
| 4,543,969 | 10/1985 | Rasmussen | 133/3 A |
| 4,549,561 | 10/1985 | Johnson et al. | 133/3 A |
| 4,564,036 | 1/1986 | Ristvedt | 133/3 A |
| 4,564,037 | 1/1986 | Childers et al. | 133/3 A |
| 4,570,655 | 2/1986 | Raterman | 133/3 A |
| 4,586,522 | 5/1986 | Taipale et al. | 133/3 E |
| 4,607,649 | 8/1986 | Taipale et al. | 133/3 C |

*Primary Examiner*—Joseph J. Rolla
*Assistant Examiner*—Edward S. Ammeen
*Attorney, Agent, or Firm*—Quarles & Brady

[57] ABSTRACT

A coin sorter has a rotating disc with a resilient upper surface that operates in conjunction with an overlying stationary sorter plate. The plate has a nominal plane surface that is spaced from the resilient surface of the disc a distance less than the thickness of the thinnest coin to be sorted. A series of recesses are provided from the nominal surface. Each recess has inwardly and outwardly facing converging shoulders which extend from a distance at least as great as the diameter of the largest coin to a distance which is less than the contact width of the smallest coin. Coins are deposited on the disc through a central opening in the plate and are moved through the recesses. The converging shoulders form the coins into a single file against one of the shoulders and strip overlapped or interleaved coins so that a single layer of coins is formed in a single file adjacent the perimeter of the disc. A series of peripherally spaced slots are formed near the perimeter of the plate each having a width that is unique to a diameter of one of the coins to be sorted. The coins leaving the last recess are pinched between the plate and resilient surface and enter the slots where they continue to be pinched and are driven against a curved forward edge of the slot which leads the coins off of the disc into collection points.

25 Claims, 2 Drawing Sheets

FIG. 1
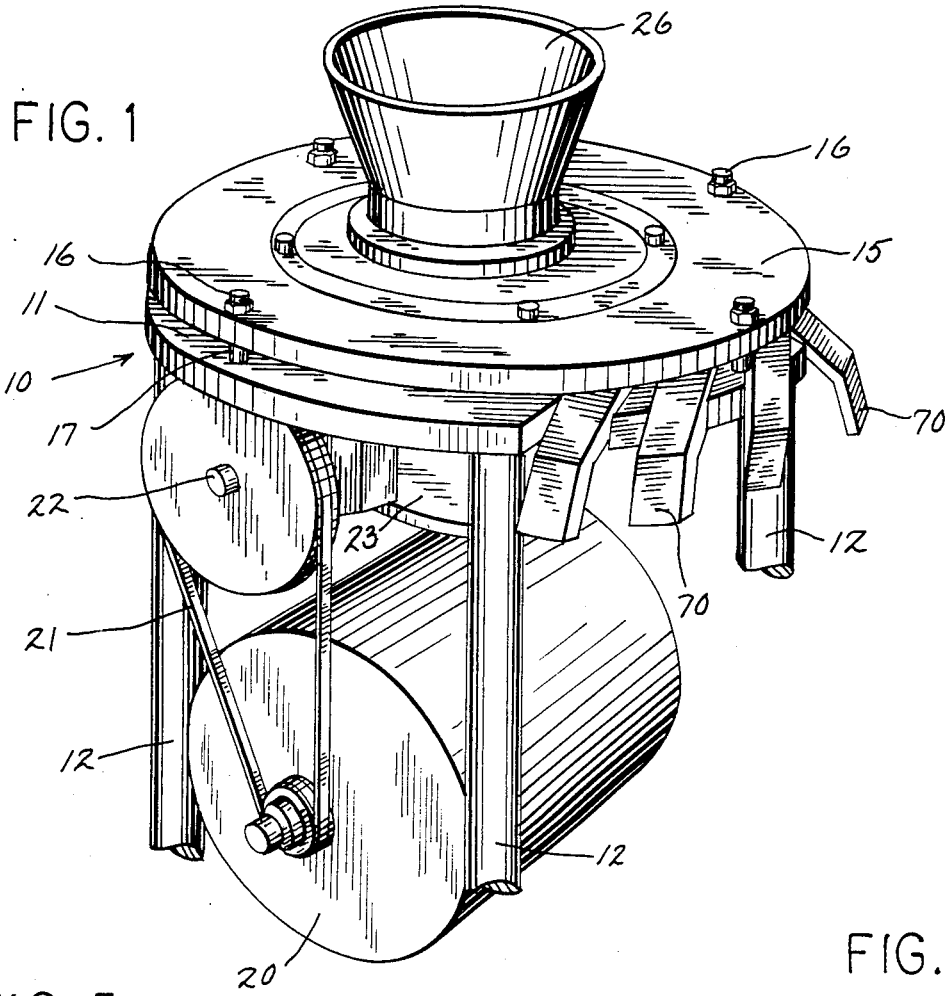
FIG. 5
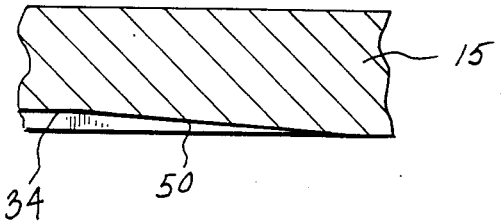
FIG. 6
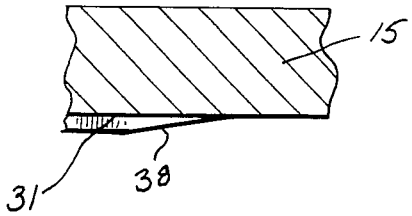
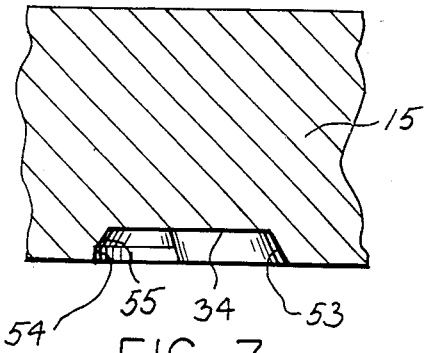
FIG. 7
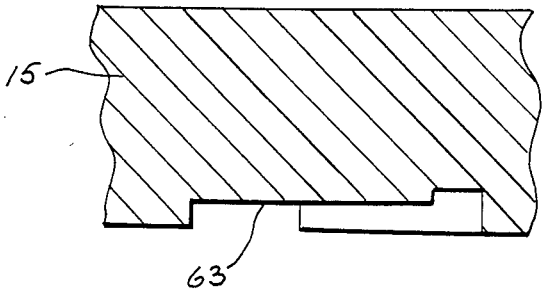
FIG. 8

FIG. 2
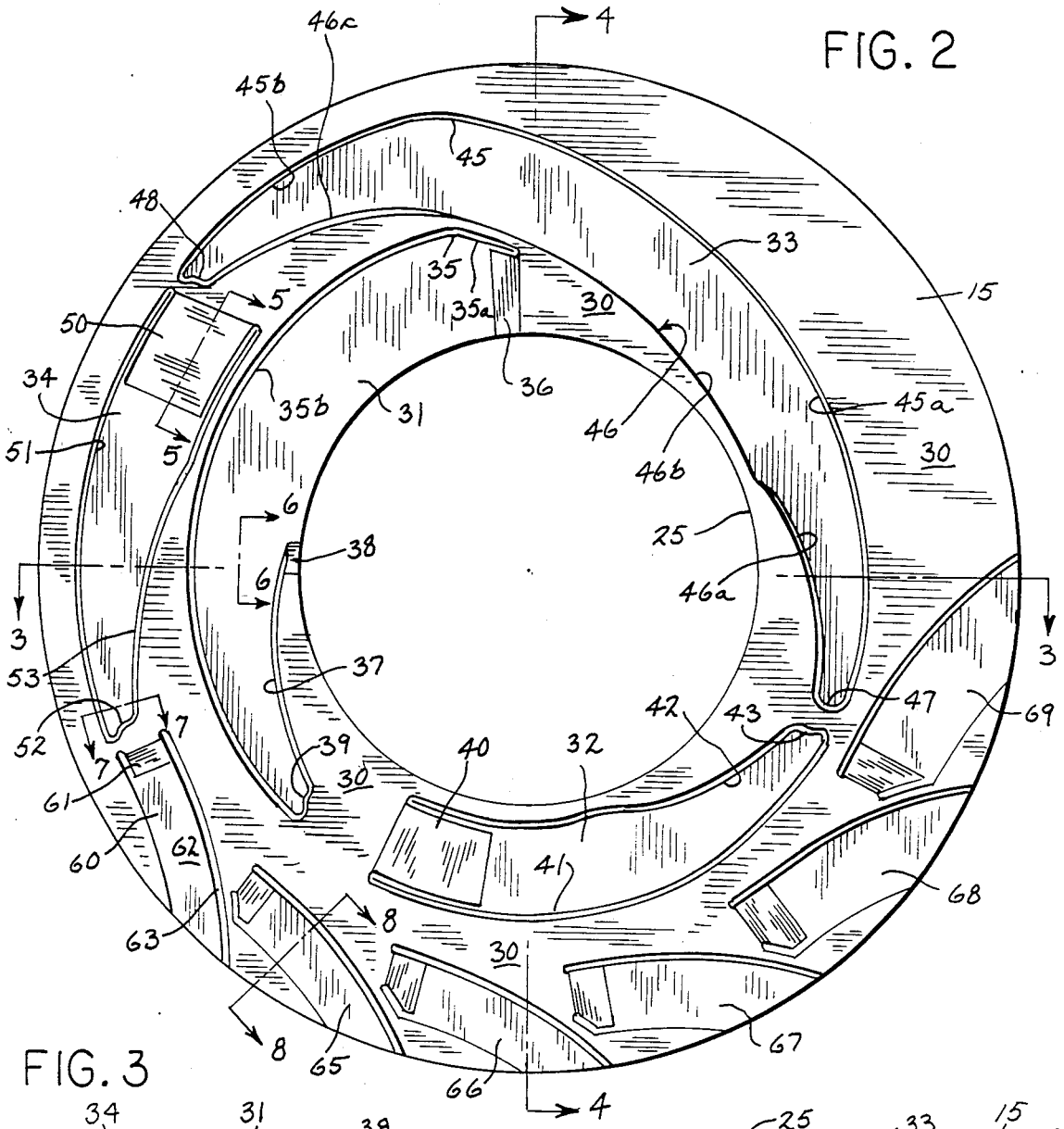
FIG. 3
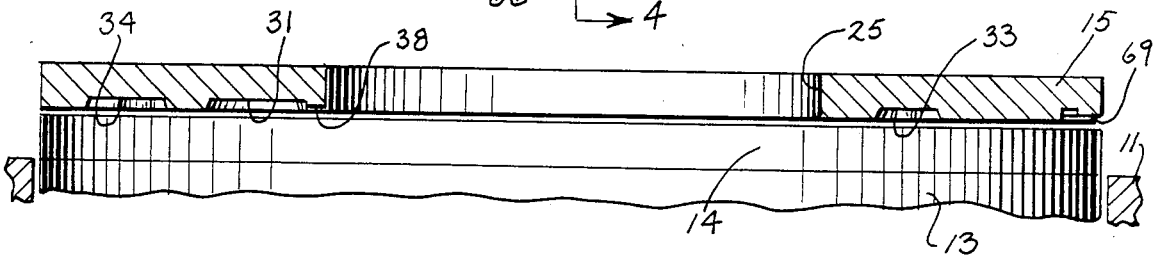
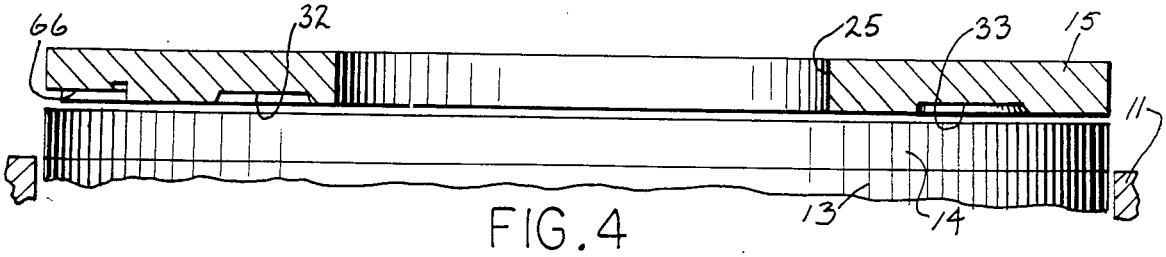
FIG. 4

RESILIENT DISC COIN SORTER HAVING RECESSES CONVERGING IN THE DIRECTION OF COIN TRAVEL

BACKGROUND OF THE INVENTION

This invention relates to coin handling, and more particularly to an improved coin sorter of the type that employs a rotating resilient disc working in conjunction with a stationary sorting plate.

One type of coin sorter employs a horizontal rotating disc with a resilient pad on its surface and a stationary plate above the rotating disc. The plate has surfaces and recesses that function to align coins deposited on the center of the rotating disc into a single layer and in a single file near the perimeter of the rotating disc. Once the coins are in a single file and a single layer, they are typically sorted off of the rotating disc at spaced positions about the periphery of the disc that are unique to each denomination of coin.

There are many examples of this type of coin sorter in the prior art. The examples differ primarily in the manner in which the coins are removed from the rotating disc after they have been aligned into a single file, and in whether the coins are aligned with their inner or outer edges against a shoulder or rim. U.S. Pat. No. 4,086,928 issued May 2, 1978 to Ristvedt, et al. discloses a sorter that flips the coins over a peripheral rim on the rotating disc to sort them denomination by denomination after they have been aligned against the rim. U.S. Pat. No. 4,098,280 issued July 4, 1978 to Ristvedt and Johnson, and its related Pat. No. 4,531,531 issued July 30, 1985, both disclose sorters that remove the coins from the single file by freeing coins from a pinch between the resilient pad and the stationary plate and allowing the coins to be thrown off of the rotating disc by centrifugal force at different points unique to their denomination. The single file of coins is aligned against an inwardly facing shoulder in the plate. A similar sorter is shown in U.S. Pat. No. 4,543,969 issued Oct. 1, 1985 to Rasmussen. Still another approach is found in U.S. Pat. No. 4,607,649, issued Aug. 29, 1986, in which the coins in a single file against an outwardly facing shoulder in the plate are physically removed from the pinch at the periphery of the rotating disc by encountering stationary plows spaced about the periphery of the disc.

In the prior resilient pad sorters, the coins are aligned by being released from the pinch so that they are free to move by centrifugal force to the inwardly facing rim or shoulder, or the coins are driven against an outwardly facing shoulder which is in the path of travel of the coins. The greatest difficulty in such sorters is not in aligning the coins against a shoulder or rim, but in removing coins that have interleaved with other coins to form two or more fully or partially overlapped coins.

The coin handling apparatus of the present invention also utilizes a rotating resilient pad cooperating with a stationary plate. However, the stationary plate is provided with a series of recesses which provide an improved alignment of coins into a single layer and then to a single file by engaging the coins in a manner which reduces the overlapping or interleaving of coins as they are aligned against a shoulder in the plate. The approach of the present invention, although particularly designed for coin sorters can also be used in any coin handling equipment, such as coin counters, in which coins must be aligned into a single layer and single file before they are further processed.

SUMMARY OF THE INVENTION

In accordance with the invention, a coin handling apparatus includes a rotating disc with a resilient surface and a stationary sorter plate having a central opening through which coins can be deposited on the rotating disc. A nominal surface of the sorter plate is spaced from the flexible pad a distance less than the thickness of the thinnest coin to be handled. The sorter plate includes successive recesses from the nominal surface, each of which is characterized by having inwardly and outwardly facing arcuate shoulders which converge in the direction of travel of coins relative to the sorter plate. The inwardly and outwardly facing shoulders engage opposite edges of coins, and the shoulders of the successive recesses define a path from the central opening towards the perimeter of the disc.

Further in accordance with the invention, the surface of one of the shoulders in each recess is inclined with respect to a plane normal to the nominal surface. Each coin is urged between the shoulders until the shoulders converge to a distance less than the contact width of the coin whereupon an edge of the coin will ride over the inclined surface of the one shoulder and will be pinched between the nominal surface of the plate and the resilient surface of the disc.

Also further in accordance with the invention, the inwardly and outwardly facing shoulders of the recesses converge from a distance which is at least as great as the diameter of the largest coin to be handled to a point where the shoulders merge, or nearly merge, and present an end wall that is transverse to the direction of travel of the coins.

In the preferred embodiment, there are two pairs of recesses. A first pair directs coins from the central opening to a first radial position, with the coins aligned against an inwardly facing shoulder, while stripping off overlapped or interleaved coins. A second pair of recesses directs coins from the first radial position to a second radial position aligned against an inwardly facing shoulder near the perimeter of the disc while stripping off any overlapped or interleaved coins that develop in moving from the first radial position to the second radial position.

It is a principal object of the invention to provide a coin handling apparatus which has an improved arrangement for aligning coins into a single file and single layer.

It is another object of the invention to provide an improved stationary sorter plate for a resilient pad type coin handling mechanism which is subjected to less wear than those which have heretofore been used.

The foregoing and other objects and advantages of the invention will appear in the following detailed description. In the description reference is made to the accompanying drawings which illustrate a preferred embodiment.

BRIEF DESCRIPTION OF THE DRAWINGS

FIG. 1 is a view in perspective of a coin sorter incorporating the present invention;

FIG. 2 is a plan view of the underside of the stationary sorter plate;

FIGS. 3 and 4 are views in vertical section through the stationary plate and rotating disc and taken in the plane of the lines 3—3 and 4—4 in FIG. 2, respectively; and FIGS. 5, 6, 7 and 8 are enlarged views in vertical section through the sorter plate and each taken in the plane of a respective set of lines in FIG. 2.

DETAILED DESCRIPTION OF THE PREFERRED EMBODIMENT

Referring to FIG. 1, the coin sorter includes a lower assembly 10 which has an outer ring 11 supported on a series of legs 12 at a level above a table top or other surface on which the sorter is positioned. The outer ring 11 has a large central opening which accommodates a horizontal disc 13 having an upper surface in the form of a resilient pad 14. A sorter plate 15 is mounted above the horizontal disc 13 on a series of threaded bolts 16 with spacers 17 which control the spacing between the sorter plate 15 and the top surface of the resilient pad 14.

An electric motor 20 is disposed beneath the lower assembly and is connected by a belt drive 21 to the input shaft 22 of a right angle drive 23 which drives the shaft for the rotatable disc 13.

The sorter plate 15 has a central opening 25. A hopper 26 is connected to the opening 25 so that a supply of coins can be directed through the opening 25 to the top surface of the pad 14.

The resilient pad 14 is formed of a natural or synthetic rubber or other elastomer, or of an elastomeric, or a combination of these materials. The pad 14 has a relatively high coefficient of friction at its top surface. The sorter plate 15 is formed of metal and therefore has surfaces which have a low coefficient of friction in comparison with that of the pad 14. As a result, rotation of the pad will urge coins to move with the pad and to slide over the surfaces of the sorter plate 15. The resilient pad 14 is also deformable to accommodate coins that are pressed or pinched between the pad and the surfaces of the sorter plate 15.

The sorter plate has a nominal flat surface 30 which is spaced from the top surface of the resilient pad 14 a distance which is less than the thickness of the thinnest coin to be handled. Thus, any coins which are in a space between the nominal surface 30 and the pad 14 will be pinched as they are rotated by the pad. A succession of recesses are provided that extend inwardly into the sorter plate from the nominal surface 30. In the embodiment shown, there are four recesses 31, 32, 33 and 34. Each of the recesses has a flat ceiling which is spaced from the surface of the resilient pad 14 some distance which can be independent of the thickness of the coins to be handled, except that the ceiling of the first recess 31 must be spaced from the pad surface sufficient to allow even the thickest coin to be accepted into the first recess 31.

Each of the recesses 31, 32, 33 and 34 also includes inwardly and outwardly facing arcuate shoulders which define the sides of the recess. In the first recess 31, the inwardly facing shoulder 35 has a portion 35*a* which extends from a ramp 36 adjacent the central opening 25 in the plate 15 and merges with a circular portion 35*b* that is at a fixed radius with respect to the axis of rotation of the disc 13. The outwardly facing shoulder 37 leads from another ramp 38 at the central opening 25. In the preferred embodiment, the outwardly facing shoulder 37 converges toward the inwardly facing shoulder 35 until the shoulders 35 and 37 merge at the end of the first recess 31 and form an end wall portion 39 that is generally radial and transverse to the direction of rotation.

The second recess 32 begins with an entrance ramp 40 which extends from the nominal surface 30 to the level of the ceiling of the second recess 32. The inwardly facing shoulder 41 of the second recess 32 is at a constant radius from the axis of rotation of the disc 13 and is at a slightly larger radius than the constant radius portion 35*b* of the inwardly facing shoulders of the first recess 31. The outwardly facing shoulder 42 extends from the ramp 40 and converges towards the inwardly facing shoulder 41 until the shoulders merge to define an end wall 43 to complete the definition of the second recess 32.

The third recess 33 includes an inwardly facing shoulder 45 which has a first portion 45*a* which begins at a slightly larger radius than that of the inwardly facing shoulder 41 of the second recess 32 and extends in a spiral direction to a second portion 45*b* at a larger constant radius adjacent the perimeter of the disc 13. The outwardly facing shoulder 46 of the third recess 33 is formed of three portions: a first portion 46*a* that diverges from the inwardly facing shoulder 45 at the entrance 47 to the third recess 33; and intermediate portion 46*b* which is parallel to the first portion 45*a* of the inwardly facing shoulder 45; and a final portion 46*c* which converges toward and merges with the second portion 45*b* of the inwardly facing shoulder at an end wall 48 of the third recess 33.

The fourth and final recess 34 begins with an entrance ramp 50 which extends from the nominal surface 30 to the ceiling of the final recess 34. The recess 34 has an inwardly facing shoulder 51 which is at a constant radius that is at a slightly larger radius than that of the second portion 45*b* of the third recess 33. The inwardly facing shoulder 51 merges at an end wall 52 with a converging outwardly facing shoulder 53 to complete the definition of the final recess.

Each of the outwardly facing shoulders has a surface that is inclined from a plane normal to the nominal surface 30. The only exception is the intermediate portion 46*b* in the third recess which has a surface that is normal to the nominal surface 30. The inwardly facing shoulders are each formed with a surface immediately adjacent to the nominal surface 30 that is normal to that surface, and a surface which is inclined to the normal. The shape of the surfaces of the shoulders 51 and 53 is shown in exaggerated form in FIG. 7, which illustrates the normal surface 54 and inclined surface 55 in the inwardly facing shoulder 51. The shoulders shown in FIG. 7 are typical of all of the shoulders. The angle of the inclined surfaces from the normal may vary, but it is important that the degree of inclination of the outwardly facing shoulders is greater than the degree of inclination of the inclined surface of the inwardly facing surfaces.

Each of the recesses 31, 32, 33 and 34 has a maximum width between the inwardly and outwardly facing shoulders which is at least as great as the diameter of the largest coin to be handled. Each of the recesses also converges to a minimum distance before the exit which is less than the width across the smallest coin to be handled when measured from the contact point at one shoulder to the contact point at the opposite, converging shoulder. This is the contact width of the coin, and it is somewhat less than the diameter of the coin because the shoulders do not contact a coin at diametrically opposite points on a coin.

The purpose of the first and second recesses 31 and 32 is to move the coins that are deposited on the disc 13 to a first radial position defined by the inwardly facing shoulder 41 of the second recess 32 while removing overlapping and interleaving of coins. Coins deposited on the rotating disc 13 will tend by reason of centrifugal force to enter the space between the ceiling of the first recess 31 and the surface of the pad 14. The thickest coins will be able to enter such recess only one at a time but the thinnest coins or combinations of thin and thick coins could well enter the space in more than one layer. Centrifugal force will urge each coin entering the space towards engagement with the inwardly facing shoulder 35. Even the largest diameter coin which is aligned against the shoulder 35 will pass beyond the ramp 38 without engaging the ramp. However, coins which are not aligned against the inwardly facing shoulder 35 will travel up the ramp 38 and be pinched between the nominal surface 30 and the pad 14. The pinched coins will be carried around by the rotating disc 13 until they travel over the ramp 36 and re-enter the space between the ceiling of the first recess 31 and the pad 14.

Coins which are aligned against the shoulder 35 enter the area in which the inwardly facing shoulder 35 and outwardly facing shoulder 37 converge. In that area the coins are continually urged by the outwardly facing shoulder 37 to a position against the inwardly facing shoulder 35. At some point in its travel, each coin will by reason of its size be too large to be accommodated between the shoulders. At that point, the radially inner edge of the coin will ride along the inclined surface of the outwardly facing shoulder 37 until it is pinched between the pad 14 and nominal surface 30. The coins are tilted somewhat as they ride over the outwardly facing shoulder 37 and are held against the inwardly facing edge 35*a*. The smaller slope and the upright normal surface of the inwardly facing shoulder 35 will combine to prevent coins from riding over the inwardly facing shoulder 35 and thereby prevent coins from slipping out of the wedge created by the converging shoulders.

If two coins are overlapped or interleaved in the converging area, the one against the surface of the pad will be stripped off of the other coin and advanced into the pinch before the other. Eventually, all coins that are properly positioned against the inwardly facing shoulder 35 are pinched between the pad and the nominal surface 30 as they leave the first recess 31. The top one of any overlapping coins that are about to leave the first recess will encounter the end wall 39 and be retarded somewhat and the coin closest to the pad surface will be advanced and stripped from the overlapped coin. The coins are pinched and carried by the rotating disc 13 in the same radial position that they exit the first recess 31.

Coins leaving the first recess 31 will have their radially outer edges aligned at the radius of the inwardly facing shoulder portion 35*a* and most overlapping coins will have been stripped from each other. It is possible, particularly among the thinner coins, that more than two coins can overlap in a recess and not be completely stripped when they exit a recess. The second recess 32 has as its purpose the removal of any remaining overlapped conditions. The coins enter the second recess 32 down the gently sloping ramp 40 and soon encounter the converging shoulders 41 and 42. The radius of the inwardly facing shoulder 41 of the second recess 32 is slightly larger than that of the preceding portion 35*b* of first recess 31 to insure that the coins will fully enter the second recess without being pinched. Once again, each coin will eventually contact both shoulders and will begin to ride out of the second recess 32 over the surface of the outwardly facing shoulder 42. In doing so, the coin of any overlapped coins that is closest to the surface of the pad will be advanced ahead of those behind it and as a result will be stripped from the coins with which it is layered.

The function of the third and fourth recesses 33 and 34 is to move the single file of coins, which are now in a single layer at an intermediate radial position, outwardly to a position along a radius that is near the perimeter of the rotating disc. In moving the coins outwardly to a larger radius, there is a danger that coins will again become overlapped, particularly the thinner coins. Therefore, there are again two recesses 33 and 34, to insure that overlapped coins will be stripped from each other. The third recess 33 moves the coins to the larger radius and begins the stripping process. The final recess 34 completes the stripping of overlapped coins.

Coins in the final recess 34 are aligned in a single file along a radius defined by the inwardly facing shoulder 51 and are also in a single layer by reason of having been stripped throughout the passage through the various recesses. Once the coins are in that condition they are ready to be sorted off of the sorter plate.

In the embodiment illustrated, the coins are sorted off of the plate by encountering a succession of slots each uniquely matched to the diameter of a particular denomination of coin. There are six slots in the embodiment illustrated, one for each of the denominations of U.S. coins including the Susan B. Anthony dollar. The first slot 60 is of a width to accommodate a dime. The slot 60 includes an entrance ramp 61 leading from the nominal surface 30 to the ceiling 62 of the slot 60. The edges of the slot 60 extend along arcs which are tangent to the diameter of the dimes at the inwardly facing shoulder 51 of the final recess 34. A forward edge 63 of the slot 60 is defined by an upstanding shoulder which is machined to a depth greater than that of the depth of the ceiling 62. This ensures that the forward edge 63 is sharply defined. The ceiling 62 is at a distance from the surface of the rotating pad 14 that is less than the thickness of a dime so that each dime leaving the final recess 34 will be continuously pinched between the sorter plate 15 and the pad 14 even after each dime in the single file travels down the ramp 61 and into the slot 60. Because the dime is continuously pinched, it is forced by the rotating pad 14 against the forward edge 63 and is physically driven along the slot 60 and off the perimeter of the rotating disc.

Each of the remaining slots 65, 66, 67, 68 and 69 are of a width to accept only pennies, nickels, quarters, Susan B. Anthony dollars, and half dollars, respectively. Each of such slots is formed in the same manner as the slot 60 for dimes, and in each the ceiling is at a depth that insures that the coins will be continuously pinched. Coins from the single file, single layer of coins exiting the final recess 34 will continue to be rotated along the circular path defined by the radius of the inwardly facing edge 51 of the fourth recess. As each coin encounters its appropriate slot, it will be forced by the pad against the forward edge of that slot and off of the disc.

As the coins exit the disc perimeter they encounter respective chutes 70, as shown in FIG. 1, which carry the coins to points of collection. The points of collection may be drawers or bags. The coins may also be counted individually as they exit the disc, in known manners.

The inwardly and outwardly facing shoulders of each recess need not actually merge. It is sufficient that they converge to a distance apart that is less than the contact width of the smallest coin, and that the shoulders also converge to the point where they can define the end walls 39, 43, 48 and 52.

In the preferred embodiment, the coins are aligned against inwardly facing shoulders which define a path from the central opening 25 in the plate 15 to a position adjacent the perimeter of the disc 13. The coins could instead be aligned against the outwardly facing shoulders by providing the inwardly facing shoulders with an inclined surface over which the coins can ride out of the recess after they have been forced against the outwardly facing shoulders. Furthermore, the shoulders against which the coins are aligned need not be at a constant radius but could follow a slight outward spiral.

The ramps 40 and 50 leading into the second and final recesses 32 and 34 have as their purpose to provide a gentle, flat release of coins from the pinch to the recess. The ramps can be replaced by an entrance similar to that in the third recess 33 characterized by diverging shoulders.

The recesses with the converging shoulders engage the coins at radially opposite edges of the coins as the coins are formed into the appropriate single file and single layer. The coins are not tipped in the direction of travel and, therefore, it is less likely that coins will interleave or overlap with each other. By reducing the tendency of coins to overlap, it is much simpler to align the coins into the single file and single layer for subsequent processing.

The recesses with converging shoulders which align the coins into a single file and single layer may be used with any of the known methods to off-sort coins. For example, the single file of coins could be removed by the use of plows as shown in U.S. Pat. No. 4,607,649.

The recesses with converging shoulders can also be used to align coins for subsequent processing in other coin handling equipment, such as coin counters.

We claim:

1. A coin handling mechanism for forming a plurality of coins into a single layer and single file, comprising:

a rotatable disc having a resilient surface;

means for rotating said disc; and a stationary plate having a nominal surface confronting the resilient surface of the disc and spaced therefrom a distance less than the thickness of the thinnest coin to be handled, said plate including a central opening so that coins may be placed against the resilient surface of the disc, said plate also having successive recesses extending inwardly from the nominal surface, said recesses each being defined by radially inwardly and outwardly facing arcuate shoulders which engage opposite edges of coins and which converge in the direction of travel of coins through said recesses, the shoulders of the successive recesses defining a path from the central opening towards the perimeter of the disc.

2. A coin handling mechanism in accordance with claim 1 wherein the path is defined by the inwardly facing shoulders of the successive recesses.

3. A coin handling mechanism in accordance with claim 1 wherein the inwardly and outwardly facing shoulders of each recess are spaced apart a distance at least equal to the diameter of the largest coin to be handled.

4. A coin handling mechanism in accordance with claim 1 wherein the shoulders have surfaces and a surface of one of the shoulders of each recess is inclined with respect to a plane normal to the nominal surface whereby coins are urged between said shoulders until the shoulders converge to a distance less than the contact width of a coin whereupon an edge of the coin will ride over the inclined surface of the shoulder and will be pinched between the nominal surface of the plate and the resilient surface of the disc.

5. A coin handling mechanism in accordance with claim 4 wherein the opposite shoulder of each recess is formed with a surface that is normal to the nominal surface and an inclined surface which extends at an angle to the normal surface.

6. A coin handling mechanism in accordance with claim 5 wherein the degree of inclination of the said one shoulder from the normal plane is greater than the degree of inclination of the inclined portion of the said opposite shoulder from the normal surface thereof.

7. A coin handling mechanism in accordance with claim 1 wherein there are two pairs of recesses, a first pair of recesses which directs coins from the central opening to a first radial position defined by a shoulder of the second recess of the first pair, and a second pair of recesses which directs coins from the first radial position to a second radial position defined by a shoulder of the second recess of the second pair.

8. A coin handling mechanism in accordance with claim 7 wherein the second radial position is disposed at a greater distance from the central opening than is the first radial position.

9. A coin handling mechanism for forming a plurality of coins into a single layer and single file, comprising:

a rotatable disc having a resilient surface;

means for rotating said disc; and a stationary plate having a nominal plane surface confronting the resilient surface of the disc and spaced therefrom a distance less than the thickness of the thinnest coin to be handled, said plate including a central opening so that coins may be placed against said disc, and said plate also having a series of recesses extending inwardly from the nominal surface, said recesses each being defined by radially inwardly and outwardly facing arcuate shoulders which engage opposite edges of the coins and which converge in the direction of travel of coins through each recess, said recesses including a first recess which extends from the central opening to receive coins placed against said disc and a final recess in which the coins are aligned in a single layer and in a single file against one of the shoulders of the final recess.

10. A coin handling mechanism in accordance with claim 9 wherein the coins are aligned against the inwardly facing shoulder of the final recess.

11. A coin handling mechanism in accordance with claim 10 wherein each outwardly facing shoulder has a surface that is inclined with respect to a plane normal to the nominal surface so that coins are urged between said shoulders until the shoulders converge to a distance less than the contact width of a coin whereupon the radially inner edge of the coin will ride over the inclined outwardly facing shoulder and will be pinched between the nominal surface of the plate and the resilient surface of the disc.

12. A coin handling mechanism for forming a plurality of coins into a single layer and single file, comprising:

a rotatable disc having a resilient surface;

means for rotating said disc; and a stationary plate having a nominal plane surface confronting the resilient surface of the disc and spaced therefrom a distance less than the thickness of the thinnest coin to be handled so that coins may be pinched between the nominal surface of the plate and the resilient surface of the disc, said plate including a central opening so that coins may be placed against said disc, and said plate having a series of recesses extending inwardly from the nominal surface, said recesses each being defined by radially inwardly and outwardly facing arcuate shoulders which engage opposite edges of the coins and which converge in the direction of travel of coins through the recesses, said recesses including a first recess which extends from the central opening to receive coins placed against said disc and a final recess in which the coins are aligned in a single layer and in a single file against the inwardly facing shoulder of the final recess, each outwardly facing shoulder having a surface that is inclined with respect to a plane normal to the nominal surface so that coins are urged between said shoulders until the shoulders converge to a point less than the contact width of a coin whereupon the radially inner edge of a coin will ride over the inclined outwardly facing shoulder and will be pinched between the nominal surface of the plate and the resilient surface of the disc.

13. A coin handling mechanism in accordance with claim 12 wherein the inwardly facing shoulders have portions that extend along a circular arc having its center at the axis of rotation of the disc.

14. A coin handling mechanism in accordance with claim 13 wherein the inwardly and outwardly facing shoulders of each recess converge from a position at which the shoulders are spaced apart a distance at least equal to the diameter of the largest coin to be handled.

15. A coin handling mechanism in accordance with claim 12 wherein the inwardly facing shoulder of each recess is formed with a surface that is normal to the nominal surface and an inclined surface which extends at an angle to the normal surface.

16. A coin handling mechanism in accordance with claim 15 wherein the angle of inclination from the normal plane of the outwardly facing shoulder is greater than the angle of inclination of the inclined portion from the normal surface of the inwardly facing shoulder.

17. A coin handling mechanism for forming a plurality of coins into a single layer and single file, comprising:

a rotatable disc having a resilient surface;

means for rotating said disc; and a stationary plate having a nominal plane surface confronting the resilient surface of the disc and spaced therefrom a distance less than the thickness of the thinnest coin to be handled so that coins may be pinched between the nominal surface of the plate and the resilient surface of the disc, said plate including a central opening so that coins may be placed against said disc, and said plate also having two pairs of recesses extending inwardly from the nominal surface, said recesses each being defined by radially inwardly and outwardly facing arcuate shoulders which engage opposite edges of the coins and which converge in the direction of travel of coins through the recesses to urge coins against the inwardly facing shoulder, a first pair of recesses including a first recess which extends from the central opening to receive coins placed against said disc and a second recess whose inwardly facing shoulder is at an intermediate radial position between the central opening and the perimeter of the disc, and a second pair of recesses including a third recess and a final recess whose inwardly facing shoulder is at a radial position near the perimeter of the disc.

18. A coin handling mechanism in accordance with claim 17 wherein the outwardly facing shoulder has a surface that is inclined with respect to a plane normal to the nominal surface whereby coins are urged between said shoulders until the shoulders converge to a distance less than the contact width of a coin whereupon the radially inner edge of the coin will ride over the inclined outwardly facing shoulder and will be pinched between the nominal surface of the plate and the resilient surface of the disc.

19. A coin handling mechanism in accordance with claim 18 wherein the second recess and final recess each include an entrance ramp which slopes in the direction of travel of coins from the nominal surface to the depth of the recess.

20. A coin handling mechanism in accordance with claim 18 together with a ramp at the location where the outwardly facing shoulder of the first recess joins with with the central opening to pinch between the plate and the disc those coins which are not against the inwardly facing shoulder of the first recess so that such coins do not enter the second recess.

21. A coin sorter, comprising:

a rotatable disc having a resilient surface;

means for rotating said disc;

a stationary plate having a nominal surface confronting the resilient surface of the disc and spaced therefrom a distance less than the thickness of the thinnest coin to be handled, said plate including a central opening so that coins may be placed against the resilient surface of the disc, and said plate also having a series of recesses extending inwardly from the nominal surface, said recesses each being defined by radially inwardly and outwardly facing arcuate shoulders which engage opposite edges of coins and which converge in the direction of travel of coins through said recesses, said recesses including a final recess in which the coins are aligned in a single layer and in a single file against a shoulder of the final recess; and a plurality of graduated sorting stations spaced about the periphery of the disc and each including means for removing coins in the single file from between the plate and the disc according to the respective diameters of the coins.

22. A coin sorter in accordance with claim 21 wherein said sorting stations each include a sorting slot extending inwardly from the nominal surface, each sorting slot having a width that corresponds to the diameter of a particular denomination to be sorted, and each slot including an arcuate edge that is in the path of the single file of coins, the depth of said slots being insufficient to release coins from the pinch between said resilient surface and the plate so that coins are driven against the edge of a respective slot and off of the rotating disc.

23. A coin sorter in accordance with claim 21 wherein said sorting stations are arranged in ascending order of the diameter of the coins to be sorted.

24. In a coin handling mechanism which includes a flexible rotating disc, and a stationary plate with a nominal surface that confronts and is spaced from the disc a distance less than the thickness of the thinnest coin, said plate having a central opening for depositing coins onto the rotating disc, and said plate having a series of recesses extending inwardly from the nominal surface which include radially inwardly facing shoulders against which the outer edges of coins will be aligned, the improvement wherein:

the recesses each have an outwardly facing shoulder which converges towards the inwardly facing shoulder in the direction of rotation of the coins over the plate to contact the inner edges of coins and urge the coins against the inwardly facing shoulder.

25. A coin handling mechanism in accordance with claim 24 wherein each outwardly facing shoulder has a surface that is inclined with respect to a plane normal to the nominal surface whereby coins are urged between said shoulders until the shoulders converge to a distance less than the contact width of a coin whereupon the radially inner edge of the coin will ride over the inclined outwardly facing shoulder and will be pinched between the nominal surface of the plate and the resilient surface of the disc.

* * * * *